United States Patent [19]

Franks, Jr.

[11] 4,312,415

[45] Jan. 26, 1982

[54] REVERSE CIRCULATING TOOL

[75] Inventor: Robert L. Franks, Jr., Lake Charles, La.

[73] Assignee: Well Tools, Inc., Lake Charles, La.

[21] Appl. No.: 145,432

[22] Filed: May 1, 1980

[51] Int. Cl.[3] ..... E21B 17/18

[52] U.S. Cl. ..... 175/215; 175/324; 137/625.31

[58] Field of Search ..... 175/65, 324, 215; 137/625.31, 32

[56] References Cited

U.S. PATENT DOCUMENTS

| | | | |
|---|---|---|---|
| 1,378,056 | 5/1921 | Reed et al. . | |
| 1,544,167 | 6/1925 | Nightingale | 175/324 |
| 1,738,135 | 12/1929 | Bannister . | |
| 2,016,066 | 10/1935 | Bannister . | |
| 2,765,146 | 10/1956 | Williams, Jr. . | |
| 2,849,214 | 8/1958 | Hall . | |
| 2,934,308 | 5/1961 | Bauer et al. . | |
| 2,946,565 | 7/1960 | Williams . | |
| 2,991,837 | 7/1961 | Postlewaite . | |
| 3,015,360 | 1/1962 | Stratton . | |
| 3,153,290 | 10/1964 | Saito . | |
| 3,259,198 | 7/1966 | Montgomery et al. . | |
| 3,362,488 | 1/1968 | Ioanesyan et al. . | |
| 3,747,698 | 7/1973 | Chapman . | |
| 3,804,186 | 4/1974 | Schoeffler | 137/625.31 |
| 4,057,118 | 11/1977 | Ford | 175/325 |
| 4,102,418 | 7/1978 | Kammerer, Jr. | 175/215 |
| 4,103,749 | 8/1978 | Erickson . | |
| 4,223,747 | 9/1980 | Marais . | |

FOREIGN PATENT DOCUMENTS

| | | | |
|---|---|---|---|
| 623954 | 9/1978 | U.S.S.R. | 175/324 |

*Primary Examiner*—William F. Pate, III

*Attorney, Agent, or Firm*—Fisher, Christen & Sabol

[57] ABSTRACT

In a combination for the drilling of a gas, oil, water and/or steam well comprised of a well hole, which is being drilled, well casing, which extends at least part of the way down the well hole, rotatable drill pipe, which extends down the well hole to the bottom thereof and which contains a passageway through the center thereof, a drill bit attached to the bottom of the drill pipe, means for rotating the drill pipe and the drill bit, and means for forcing a fluid, such as, drilling mud, down the passageway of the drill pipe to and through the drill bit, an annulus being formed by the region between the well casing and side of the well and the drill pipe, the fluid exiting out the annulus, the improvement which comprises a reverse circulating tool or device located in the casing, the device comprising a cylindrical main body, means for attaching the device to the top portion of the drill pipe, means for attaching the device to the bottom portion of the drill pipe, a first passageway in the main body communicating between the top portion of the drill pipe and the portion of the annulus located below the main body, and a second passageway in the main body communicating between the bottom portion of the drill pipe and the portion of the annulus located above the main body, the main body tightly and rotatably fitting within the well casing.

12 Claims, 7 Drawing Figures

REVERSE CIRCULATING TOOL

BACKGROUND OF THIS INVENTION

1. Field of this Invention

This invention relates to the field of drilling gas, oil, water and/or steam wells.

2. Prior Art

In the early days of drilling oil and gas wells, the wells were often drilled by cable tool. That technique involved a sharp weight on the end of a cable that pounded its way into the earth. Hydrocarbons often spewed from the well hole. The modern technique is to drill using a rotary drill, i.e., turning steel knuckles or teeth (on tungsten), located on the drill pipe.

Drilling mud is a fluid that cools the drilling bit (or teeth) while transporting rock cuttings to the surface. The mud also serves to keep any oil or gas underground.

In more detail, most modern drilling is done by means of rotary drilling. The drill bit rotates while bearing down on the bottom of the well, thus gouging and chipping its way downward. When conducting rotary drilling, the well bore is kept full of liquid during drilling. A weighted fluid (called drilling mud) in the bore hole serves at least two important purposes: (a) by its hydrostatic pressure, it prevents the entry of formation fluids into the well thus preventing blowouts and gushers; and (b) the drilling mud carries the crushed rock to the surface, so that the drilling is continuous until the bit wears out. The drill bit is connected to the surface equipment through a drill pipe, a heavy-walled tubing through which the drilling mud is fed to the bottom of the bore hole. In most cases, the drill pipe also transmits the rotary motion from a turntable at the surface to the drilling bit at the bottom of the hole. The top piece of the drill pipe is a tube of square or octagonal cross section called the kelly, which passes through a square octagonal hole in the turntable (located near the bottom of the derrick). At the bottom end of the drill pipe are extraheavy sections called drill collars that serve to concentrate the weight on the rotating bit. The drilling mud leaves the drill pipe in such a way that it washes the loose rock from the bottom and carries it to the surface. The drilling bit has a number of jets through which the drilling mud is forced by pressure into the bottom of the drill hole. Drilling mud is carefully formulated to the correct weight and viscosity characteristics for its required tasks. After screening to remove the rock chips, the returning drilling mud is held in open pits for recirculating through the well. The drilling mud is picked up by piston pumps and forced through a swivel joint into the top of the drill pipe.

The characteristic tall derrick contains the hoisting equipment that is used to raise and lower the drill pipe into the well. The drill bit wears quickly and requires frequent replacement, making it necessary to pull the entire drill string from the well and rack it at one side of the derrick. Joints of drill pipe are usually 30 feet long. Sections of two or three such joints are separated and racked vertically while the bit is being changed. Drilling mud is left in the bore hold during this time to prevent excessive flow of fluids into the well.

In drilling wells it is sometime desirable and necessary to reverse the circulation of the drilling fluid through the drill pipe and annulus. (The annulus is the region between the well casing or side and the drill pipe.) Presently, this is done through the open annulus which does not allow for rotation of the drill pipe while reverse circulating the drilling fluid.

BROAD DESCRIPTION OF THIS INVENTION

An object of this invention is to provide a device which provides for reverse circulating of drilling fluid in a closed annulus while rotating pipe. Another object of this invention is to provide a scraper action to clean the inner casing walls while circulating the drilling fluid in conventional manner or reverse circulation. A further object of this invention is to provide longer life to the drill bit by being able to drill while reverse circulating which relieves the pressure which enables drilling with less weight on the drill bit. Another object of this invention is to lower the fluid pump pressure. A still further object of this invention is to provide greater volume of drilling fluid, which increases the removal of cuttings from the well faster, therefore allowing the bit to cut more freely and increasing bit life, and which, by increasing bit life, allows more footage of hole to be made with less trip time in removing the drill pipe from the well and changing the bit. Another object of this invention is to increase fluid volume thru the annulus, thereby cleaning the annulus walls faster and better. Another object of this invention is in milling operations, to immediately remove the steel cuttings from the bit area and the drill hole. Other objects and advantages of this invention are set out herein.

The objects and advantages of this invention are achieved by the device, combination and methods of this invention.

A recent variation in rotary drilling has involved introducing a fluid-powered turbine at the bottom of the bore hole to produce the rotary motion of the bit. In such method, the drill pipe does not rotate but is used to regulate the weight on the bit and to carry the drilling mud that turns the turbine. The device of this invention cannot be used when drilling is done utilizing the fluid-powered turbine system.

This invention includes a device for reversing the flow of circulating fluid. The device includes a cylindrical body and a protrusion on the bottom of the cylindrical body. The central axis of the bottom protrusion generally lies on the central axis of the cylindrical body. The end of the bottom protrusion is externally threaded. There is a protrusion on the top of the cylindrical body. The central axis of the top protrusion generally lies on the central axis of the cylindrical body. There is also a passageway which lies generally on the central axis of the bottom protrusion and which extends through the cylindrical body to a site on the upper end surface of the cylindrical body located away from the interface of the cylindrical body and the top protrusion. There is also a passageway which lies generally on the central axis of the top protrusion and which extends through the cylindrical body to a site on the lower end surface of the cylindrical body located away from the interface of the cylindrical body and the bottom protrusion. The end of the passageway in the top protrusion is internally threaded. Preferably the externally threaded end portion of the bottom protrusion is tapered outwardly, and the internally threaded end portion of the passageway in the top protrusion is tapered inwardly. Preferably each of the passageways has a circular cross section. Preferably there are two bearing seal races located around the cylindrical body, and a bearing seal is located in each of the races.

The reverse circulating device or tool can be used in a combination for the drilling of a gas, oil, water and/or steam well. The combination includes a well hole, which is being drilled, well casing, which extends at least part of the way down the well hole, rotatable drill pipe, which extends down the well hole to the bottom thereof and which contains a passageway through the center thereof, a drill bit attached to the bottom of the drill pipe, means for rotating the drill pipe and the drill bit, and means for forcing a fluid down the passageway of the drill pipe to and through the drill bit. The annulus is formed by the region between the well casing and side of the well and the drill pipe. The main body tightly and rotably fits within the well casing in the drill hole being drilled. The circulating fluid is forced down the internal passageway of the top portion of the drill pipe, through the passageway in the device that extends through the top protrusion of the device and through the cylindrical body and out into the annulus below the cylindrical body down to the situs of the drill bit in the well hole. The fluid exits up through the drill bit, through the passageway in the device that extends through the bottom protrusion of the device and through the cylindrical body and out into the annulus above the cylindrical body up to the top of the well (and out to the holding pit or tank).

The device of this invention can be used in conjunction with gas, oil, water and/or steam (geothermal) wells.

More broadly, the reverse circulating tool of this invention (described as being located in the well casing area of a drill hole being drilled) includes a cylindrical main body, means for attaching the device to the top portion of the drill pipe, means for attaching the device to the bottom portion of the drill pipe, a first passageway in the main body communicating between the top portion of the drill pipe and the portion of the annulus located below the main body, and a second passageway in the main body communicating between the bottom portion of the drill pipe and the portion of the annulus located above the main body.

Broadly, this invention involves a reverse circulating tool for use in drilling, workover and completion of water, gas, oil and other wells where a liquid gas or air is used for drilling fluid. The reverse circulating tool allows this to be done through a closed annulus—the closed annulus is further protection against a blow out during drilling.

This invention includes another embodiment of the device for reversing the flow of circulating fluid. The device includes a cylindrical body, four passageways extending lengthwise through the cylindrical body, and a top member which is generally Y-shaped. The top member contains a Y-shaped passageway therethrough, which is affixed on the ends of its two lower arm members to the top surface of the cylindrical body so as to have the passageway in each of its lower arms communicate with one of two oppositely located passageways in the cylindrical body. The central axis of the top leg of the top Y-shaped member generally lies on the central axis of the cylindrical body. There is a bottom member which is generally Y-shaped. The bottom member contains a Y-shaped passageway therethrough, which is affixed on the ends of its two upper arm members to the bottom surface of cylindrical body so as to have each of its upper arms communicate with one of the two remaining, oppositely located passageways in the cylindrical body. The central axis of the bottom Y-shaped member generally lies on the central axis of the cylindrical body. Instead of four (preferred) passageways, two, three, five or more passageways can be present in the cylindrical body.

This embodiment can have a cylindrical body which comprises two segments which are rotatable in relation to each other. This allows the planes of the upper and lower Y-shaped members to be positioned at an angle to each other or in the same plane, whereby the flow of the circulating fluid can be reversed, stopped or made in line. This two segment embodiment can be used to reverse (or bring in line or to stop) the flow of circulating fluid in two pies, one located in the other. This two segment embodiment can be used in well drilling, in chemical process lines, conveying liquids, gases and slurries (e.g., iron and water, coal and water), etc. The two segment embodiment allows flushing and backflushing.

DETAILED DESCRIPTION OF THIS INVENTION

The preferred embodiment of this invention is set forth in the drawings, in which.

Figure 1:
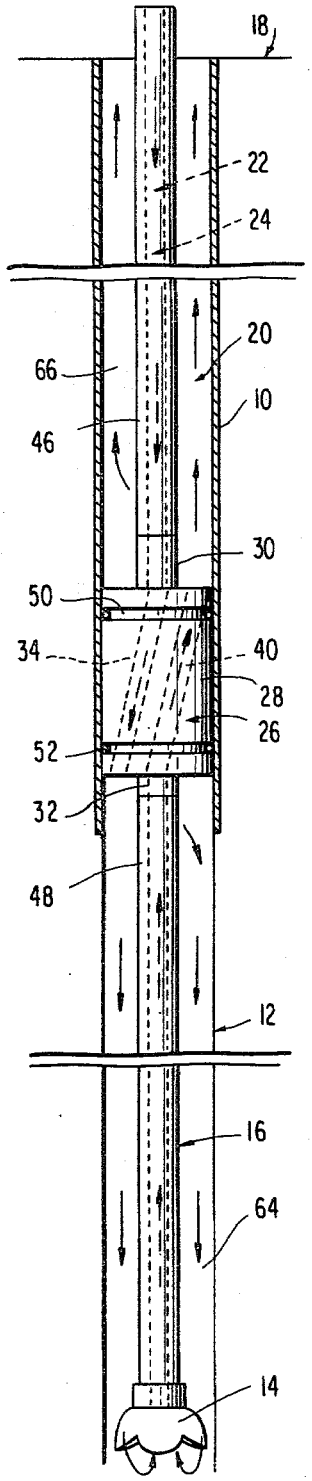
FIG. 1 is a front, partially cutaway, elevational view of a well being drilled which contains the device of this invention.

In FIG. 1, well casing 10 is located in the upper portion of drill (well) hole 12. Once drill hole 12 has been drilled to a depth of at least 30 to 40 feet (up to about 250 feet), well casing 10 is lowered into drill hole 12. Well casing 10 is typically 9 to 12 inches in internal diameter. (After drill hole 12 is completed, well casing 10 is inserted to the full depth of drill hole 12. Or, well casing 10 can be extended deeper into drill hole 12 as it is drilled deeper and deeper.) Drill hole 12 is drilled by rotating drill bit 14 which is affixed to the lower end of drill pipe 16. Drill bit 14 is rotated by the rotation of drill pipe 16. The above ground portion of the well drilling rig and derrick is conventional and is not shown. As shown in FIG. 1, well casing 10 and drill pipe 16 extend above ground level 18. Annulus 20 is formed in drill hole 12 (and well casing 10) by drill pipe 16.

In conventional practice, drilling mud (fluid) 22 is forced under pressure (pumped) down passageway 24 of drill pipe 16, out through the jets (not shown) of drill bit 14, and back up through annulus 20 to the drilling mud holding pit (not shown). The returning drilling mud carries the rock cuttings, etc., from the bit region to the surface where it is separated from the drilling mud. The drilling mud is recirculated as needed. The conventional practice is not particularly effective in removing the rock cuttings, which means a decrease in drill bit effectiveness and life.

In the practice of this invention, reverse circulating tool (device) 26 is mounted at a position along the drill train of drill pipe 16. Drill pipe 16 is a series of connected pipe segments that are added as needed as drill hole 12 is drilled deeper. Reverse circulating tool 26 is normally positioned at a position in drill hole 12 which contains well casing 10, and is preferably about 30 to 100 feet below ground level 18. The reasons for preferably positioning reverse circulating tool 26 at such a level is explained below. In case the drilling is being done offshore, then 18 is the platform deck.

Figure 2:
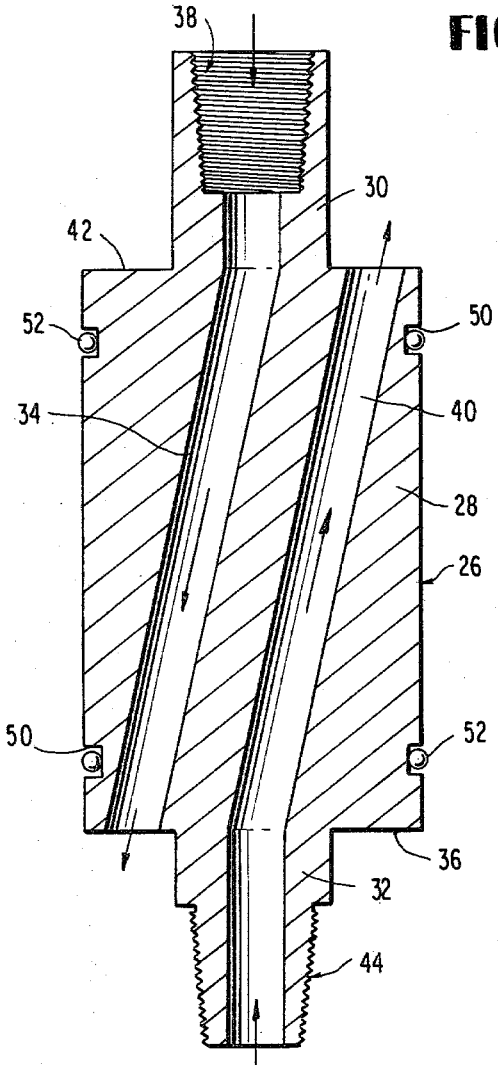
FIG. 2 is a cross-sectional (lengthwise) view of the device of this invention.

Referring to FIG. 2, reverse circulating tool 26 contains cylindrical body 28, upper member 30 and lower member 32. Upper member 30 and lower member 32 are mounted on the central axis of cylindrical body 28. Passageway 34 extends through upper member 30 and then completely through cylindrical body 28 at a slight angle to the central axis of cylindrical body 28. Passageway 34 exits on lower face 36 of cylindrical body 28 at a position that does not coincide, even partially, with lower member 32. The upper end of upper member 30 contains internally expanded portion 38 of passageway 34. Expanded portion 38 of passageway 34 is internally threaded (normally tapered). Passageway 40 extends through lower member 32 and then through cylindrical body 28 at a slight angle to the central axis of cylindrical body 28. Passageway 40 exits on upper face 42 of cylindrical body 28 at a position that does not coincide, even partially, with upper member 30. Lower member 32 is provided on its lower extremity with externally threaded portion or nipple 44 (normally tapered). Upper portion 46 of drill pipe 16 is externally threaded on its lower extremity and is screwed into upper portion 38 of upper member 30. Lower portion 48 of drill pipe 16 is internally threaded on its lower extremity and is screwed onto lower portion 44 of lower member 32. (The threading involved should be reverse to the rotational direction of drill pipe 16 so as to avoid unscrewing during the drilling operation.) Passageway 34 and passageway 40 can each have several channels (e.g., two, three, etc.) through cylindrical body 28 as long as each set of channels are mutually exclusive and do not communicate with each other.

Cylindrical body 28 tightly fits in well casing 10 with sufficient tolerance to allow rotation of cylindrical body 26 without undue drag due to friction, etc., but not so loosely as to allow significant amounts of the pressurized drilling mud to exit upwardly instead of down annulus 20. The clearance is just sufficient to hold down leakage. Preferably reverse circulating tool 26 contains two bearing races 50, wherein bearings 52 are mounted. Bearings 52 cut down on the friction forces due to the rotation of reverse circulating tool 26 in well casing 10. One, two, three or more bearing races 50, etc., can be used if desired. Also, cylindrical body 28 can contain one or more grooves and O-rings (e.g., of silicone rubber) to assist in preventing the upward passage of the drilling mud around cylindrical body 28. Reverse circulating tool 26 is positioned initially about 30 to 35 feet below ground level 18. Its position drops in drill hole 12 as its depth is increased by drilling—more drill pipe 16 is added on top of the drill train as drill hole 12 becomes deeper.

FIG. 2 shows the preferred form of reverse circulating device 26 of this invention.

In the practice of the method of this invention using reverse circulating tool 26, the flow path of the drilling mud is shown by arrows in FIG. 1. Drilling mud is forced under pressure down passageway 24 of drill pipe 16 until it comes to passageway 34 in reverse circulating tool 26. At this point the drilling mud flows through passageway 34 into lower portion 64 of annulus 20. Then, unlike the conventional practice, the drilling mud flows down lower portion 64 of annulus to the region of drill bit 14, up through drilling bit 14 into passageway 24 of lower drill pipe portion 48 and up passage 24 until it comes to reverse circulating tool 26. The drilling mud proceeds through passageway 40 into upper portion 66 of annulus 20, where the conventional flow path for the drilling mud is resumed. [To facilitate flow of the drilling mud through drill bit 14, the jets (not shown) of drilling bit 14 have been removed. The jets usually have an internal diameter of ½ to ¾ inch. Normally drill bits do not have central holes for passage of some of the drill mud, which is one of the reasons the jets should be removed.] The reversing flow cycle is also shown in FIG. 2.

The reverse flow pattern of this invention of the drilling mud provides much better cutting action by the drill bit than when the conventional flow path is used. Annulus 20 is normally larger in cross sectional area than passageway 24 of drill pipe 16. There is an increase in flow speed as the drilling mud passes through the jet holes (not shown) in drill bit 14 and up and through passage 24 of drill pipe 16. This increased flow speed means more drill cuttings are removed from the drilling bit site per unit of time than with the conventional flow path. Hence the drill bit is more effective in drilling and has an increased life. The inward flow path of the drilling mud at the site of the drilling site quickly pushes the drilling cuttings right up the drill pipe. The drill cuttings are immediately removed from drill hole 12—much faster than with the conventional system. This means faster drilling by allowing longer drill bit life. By increasing bit life, more drill hole footage can be drilled without having to remove the drill pipe train and change the drill bit.

Reverse circulating tool 26 cleans and scrapes the sides of well casing 10 as it is raised and lowered to change bits or by the addition of topside drill pipe and as it rotates—the cleaning action is better than with the conventional flow or conventional reverse circulation. This invention extends drill bit life by relieving the pressure which enables drilling with less weight on the drill bit.

The reverse flow pattern of this invention, particularly when reverse circulating tool 26 is located near the top of well casing 10, provides a cleaning action of the annulus that is faster and better than with the conventional system.

Drilling and the required rotation of the drill pipe can be done while using the reverse flow path of this invention. In conventional practice, when one reverses the flow of the drilling mud so that it enters and flows down the entire length of annulus 20 and exits up and out passageway 24 of drill pipe 16, the rotation of the drill pipe and bit must be stopped for the duration of the reverse flow.

One cannot drill if the drill pipe is not rotatable. Early in the drilling there is no blowout preventer at the top of the well. After drilling has proceeded, a blowout preventer is installed. The blowout preventer, when the mud flow is reversed, is actuated and the drill pipe cannot be turned. Well casing is normally only inserted but a few hundred feet until the well is completely drilled. The drill hole wall builds up with sand, shale and/or dirt. There is a buildup on the drill hole wall and drill pipe as drilling progresses—the conventional flow of drilling mud does not provide sufficient pressure to clean off or prevent the buildups.

Reversing circulating tool 26 can be fabricated in any suitable manner. For example, lower member 32 and upper member 34 can be welded to cylindrical body 28. Reverse circulating tool 26 can be prepared by casting or molding. Reaming, drilling, cutting, etc., is done as necessary to provide passageways 34 and 40.

Reverse circulating tool 26 is preferably constructed of steel, but can be made of any other suitable material which is of sufficient strength to withstand the high stresses and strains to which reverse circulating device 26 is subjected during the drilling sequence. Well casing 10 is usually coupled steel pipes used to provide for the sides of the well hole. Well casing 10 is constructed of steel, but can be made of any other suitable material which has sufficient strength and corrosion resistant properties.

Drilling mud is a mixture of (refined) clays, usually bentonite, and water. Special chemicals are added to the drilling mud to compensate for the varying composition of the water and the formation being drilled and to increase the weight of the column. The drilling mud can contain a gel for its slip properties. The drilling mud can contain any kind of conventional filler. The drilling mud is used in oil, gas and water drilling to carry rock cuttings to the surface and to lubricate and cool the drilling bit. The drilling mud, by hydrostatic pressure, helps prevent the collapse of unstable strata into the hole and the intrusion of water from water-bearing strata that may be encountered. The drilling mud is used to increase or decrease pressure in the drill hole, to cool and lubricate the drill bit and other machinery and to coat delicate formations whose exposed surfaces in the drill hole (well bore) need protection.

Figure 3:
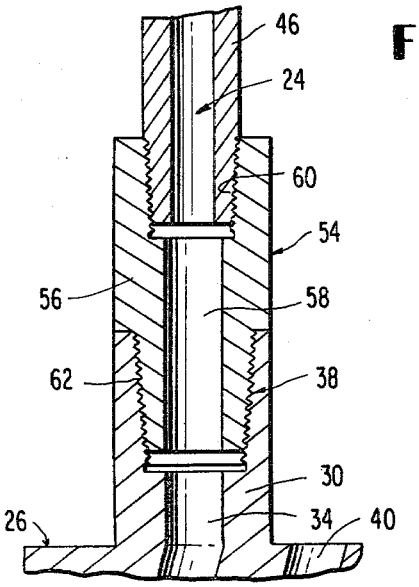
FIG. 3 is a cross-section (lengthwise) view of an adapter used with the device of this invention.

When upper drill pipe portion 46 is smaller in diameter than internally threaded end portion 38 of cylindrical body 26, adapter 54 can be used. See FIG. 3. Adapter 54 composes cylindrical body 56, central passageway 58, internally threaded (normally tapered) upper end portion 60 of central passageway 58, and externally threaded lower end portion or nipple 62 (normally threaded) of cylindrical body 56. The externally threaded end of upper drill pipe portion 46 is screwingly engaged into internally threaded upper end portion 60 of adapter 54. Externally threaded lower nipple 62 is screwingly engaged into upper portion 38 of reverse circulating tool 26. Adapter 54 can be used when upper drill pipe portion 46 is different in size from lower drill pipe portion 48. Variations of adapter 54 can be used to accommodate the attachment of lower drill pipe portion to lower portion 32 reverse circulating tool 26. As needed, the diameter of externally threaded lower nipple 62 can be less than the diameter of internally threaded upper portion 60—the lower end of passageway 58 may be reduced in size to achieve this. Or, the diameter of internally threaded upper portion 60 can be expanded with concurrent expansion of the upper end of body 26.

If desired, bearing 52 can be replaced by an O-ring of deformable rubber of the like.

Reverse circulating device 26 can be used in any situation where the reversing the flow of a fluid is desired—it is not restricted in use to the drilling of well bores.

Figure 4:
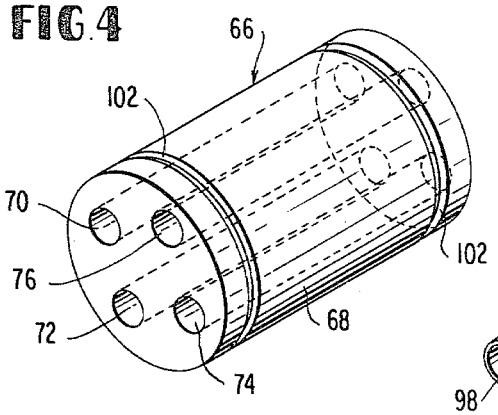
FIG. 4 is a perspective view of the main body of another device of this invention.
Figure 5:
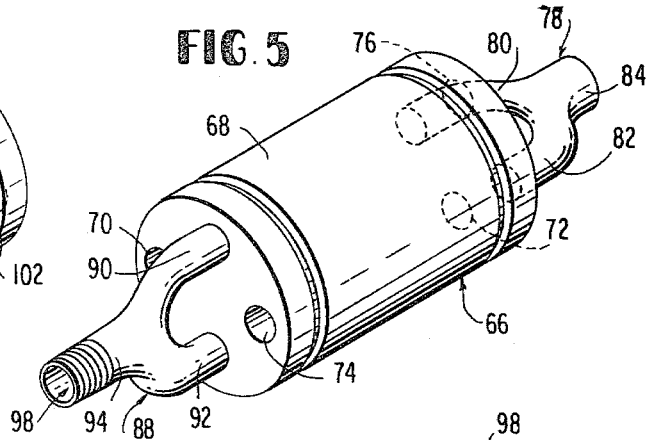
FIG. 5 is a perspective view of another device of this invention.
Figure 6:
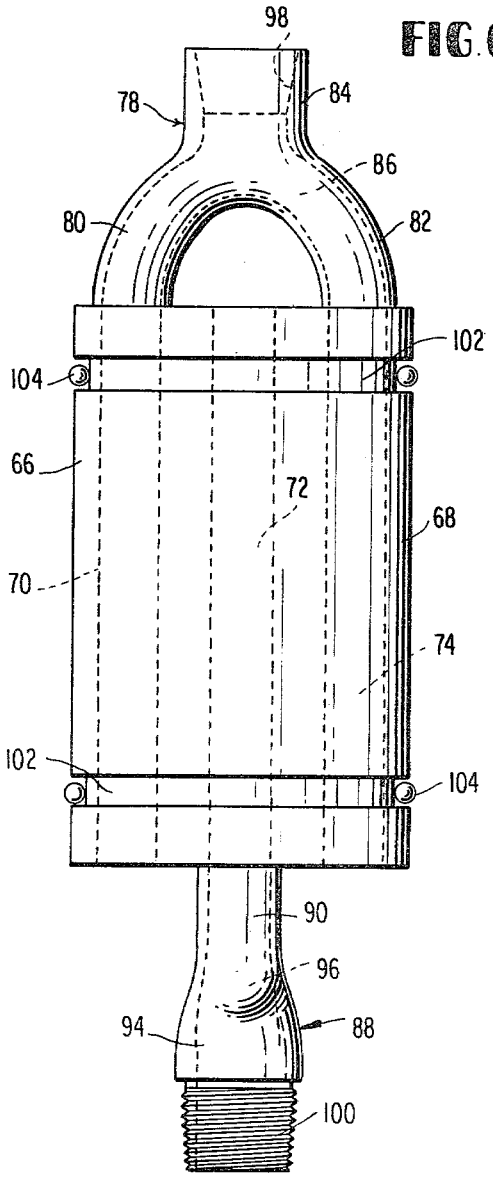
FIG. 6 is a side view of another device of this invention.

Another embodiment of the reverse circulating tool (66) of this invention is shown in FIGS. 4 to 6. Cylindrical body 68 has four passageways 70, 72, 74 and 76 extending lengthwise therethrough. Passageways 70, 72, 74 and 76 are located on a circle, ninety degrees apart. See FIG. 4. Upper member 78 is generally Y-shaped, and has two lower arms 80 and 82 and upper arm 84. Upper member 78 contains Y-shaped passageway 86 therein. The two lower branches of Y-shaped passageway 86 coincide and communicate, respectively, with passageways 70 and 74 of cylindrical body 68. See FIG. 6. Lower member 88 is located at a right angle to upper member 78. Lower member 88 is generally Y-shaped, and has two upper arms 90 and 92 and lower arm 94. Lower member 88 contains Y-shaped passageway 96 therein. The two upper branches of Y-shaped passageway 96 coincide and communicate, respectively, with passageways 72 and 76 of cylindrical body 68. Upper end portion 98 of passageway 86 is internally threaded (normally tapered). Lower member 88 is provided on its lower extremity with externally threaded portion 100 (normally tapered).

Preferably reverse circulating tool 66 contains two bearing races 102 wherein bearings 104 (or an O-ring) are mounted.

In operation, reverse circulating tool 66 can be used in place of reverse circulating tool 26. The description of the operation of reverse circulating tool 26 applies to reverse circulating tool 66. Both achieve their result, in part, from the larger surface area of the annulus compared to the drill pipe (hole) surface area, and the fact that the jets of a drill bit provide much less carrying capacity to remove sand, shale, rock cuttings, etc., as compared to the entire drilling mud flow pressure provided by this invention. It should be noted that preferably as a new drill pipe segment is to be added, the pipe train is raised to a position so the reverse circulating tool can be removed and placed on top of the added pipe segment—this allows the reverse circulating tool to remain near the top of the well casing.

Figure 7:
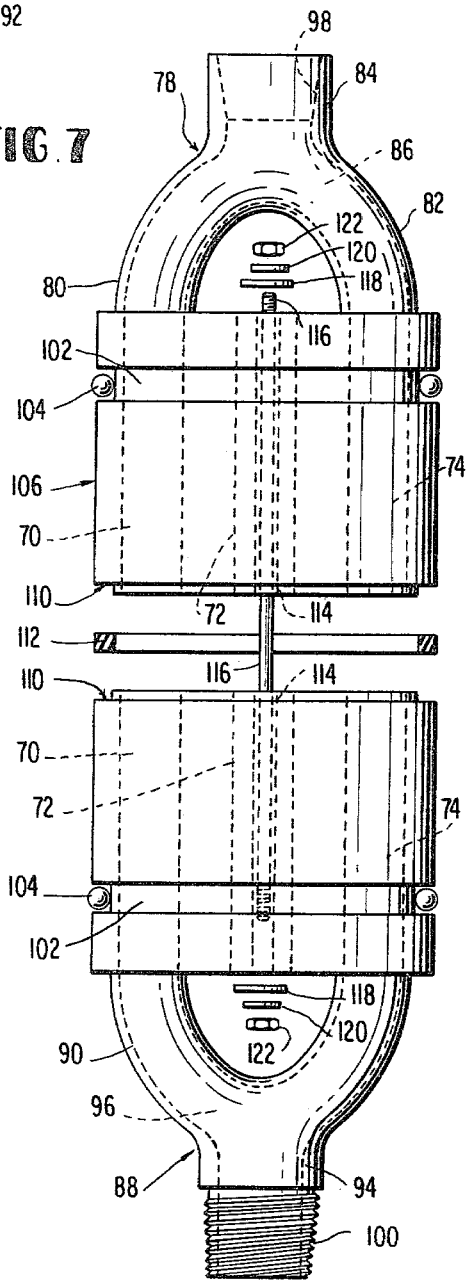
FIG. 7 is an expanded side view of a further device of this invention.

FIG. 7 shows a version of reverse circulating tool 66 whereby flow of the drilling mud can be stopped, reversed or placed in line (the conventional mode). In FIG. 7, reverse circulating tool 66 is composed of upper section 106 and lower section 108. The mating faces of upper section 106 and lower section 108 each contain lip groove 110, in which seal 112 (preferably silicone rubber) fits. Any suitable material can be used for seal 112 provided it allows sealing and rotation and is resistant as necessary to chemicals and/or heat. Upper section 106 and lower section 108 are rotatable in relation to each other. Means (not shown) can be provided to lock them in fixed relation to each other—this can be done by one or more rods extending through both. Means (not shown) can be provided to allow positioning them in relation to each other—this can be rods positionable in several different holes extending through both of them. To provide the facility of rotation, bore 114 is located on the central axis of upper segment 106 and lower segment 108 and extends through both. Rod 116 extends through bore 114 and is sealed and fastened on each end by seal 118, washing 120 and bolt 122. This two segment version can also be used as described above in chemical process equipment and fluid and slurry transportation lines where there are two concentrically located pipes.

What is claimed is:

1. A device for reversing the flow of circulating fluid which comprises a cylindrical body, which has a flat upper surface and a flat lower surface, the flat upper surface and the flat lower surface being perpendicular to the central axis of the cylindrical body, a protrusion on the bottom of the cylindrical body, the central axis of the bottom protrusion generally lying on the central axis of the cylindrical body and the end of the bottom protrusion being externally threaded, the width of the bottom protrusion being less than the diameter of the cylindrical body, a protrusion on the top of the cylindrical body, the central axis of the top protrusion generally lying on the central axis of the cylindrical body, the width of the top protrusion being less than the diameter of the cylindrical body, a first passageway which lies generally on the central axis of the bottom protrusion and which extends through the cylindrical body to a site on the upper end surface of the cylindrical body located away from the interface of the cylindrical body and the top protrusion, and a second passageway which lies generally on the central axis of the top protrusion and which extends through the cylindrical body to a site on the lower end surface of the cylindrical body located away from the interface of the cylindrical body and the bottom protrusion, the end of the first passageway in the top protrusion being internally threaded, the first passageway and the second passageway not intersecting.

2. The device as claimed in claim 1 wherein the externally threaded end portion of the bottom protrusion is tapered inwardly, and the internally threaded end portion of the passageway in the top protrusion is tapered outwardly.

3. The device as claimed in claim 2 wherein each of the passageways has a circular cross section.

4. The device as claimed in claim 2 wherein at least one bearing seal race is located around the cylindrical body, and a bearing seal is located in each of the races.

5. A device for reversing the flow of circulating fluid which comprises a cylindrical body, four passageways extending lengthwise through the cylindrical body, a top member which is generally Y-shaped, which contains a Y-shaped passageway therethrough, which is affixed on the ends of its two lower arm members to the top surface of the cylindrical body so as to have the passageway in each of its lower arms communicate with one of two oppositely located passageways in the cylindrical body, the central axis of the top leg of the top Y-shaped member generally lying on the central axis of the cylindrical body, and a bottom member which is generally Y-shaped, which contains a Y-shaped passageway therethrough, which is affixed on the ends of its two upper arm members to the bottom surface of the cylindrical body so as to have each of its upper arms communicate with one of the two remaining, oppositely located passageways in the cylindrical body, the central axis of the bottom Y-shaped member generally lying on the central axis of the cylindrical body.

6. The device as claimed in claim 5 wherein the end portion of the passageway of the top leg of the top Y-shaped member is internally threaded, and the end portion of the bottom Y-shaped member is externally threaded.

7. The device as claimed in claim 6 wherein the externally threaded end portion of the lower is tapered inwardly, and the internally threaded end portion of the passageway in the top protrusion is tapered outwardly.

8. The device as claimed in claim 6 wherein all of the passageways have a circular cross section.

9. The device as claimed in claim 6 wherein at least one bearing seal race is located around the cylindrical body, and a bearing seal is located in each of the races.

10. The device as claimed in claim 5 wherein the cylindrical body comprises two segments which are rotable in relation to each other, thereby allowing the planes of the upper and lower Y-shaped members to be positioned at an angle to each other or in the same plane, whereby the flow of the circulating fluid can be reversed, stopped or made in line.

11. In a combination for the drilling of a gas, oil, water and/or steam well comprised of a well hole, which is being drilled, well casing, which extends at least part of the way down the well hole, rotatable drill pipe, which extends down the well hole to the bottom thereof and which contains a passageway through the center thereof, a drill bit attached to the bottom of the drill pipe, means for rotating the drill pipe and the drill bit, and means for forcing a fluid down the passageway of the drill pipe to and through the drill bit, an annulus being formed by the region between the well casing and side of the well and the drill pipe, the fluid exiting out the annulus, the improvement which comprises a device located in the casing, the device comprising a cylindrical body, four passageways extending lengthwise through the cylindrical body, a top member which is generally Y-shaped, which contains a Y-shaped passageway therethrough which is affixed on the ends of its two lower arm members to the top surface of the cylindrical body so as to have the passageway in each of its lower arms communicate with one of two oppositely located passageways in the cylindrical body, the central axis of the top leg of the top Y-shaped member generally lying on the central axis of the cylindrical body, the top leg of the top Y-shaped member attached to the top portion of the drill pipe, the Y-shaped passageway of the top member communicating with the top portion of the drill pipe, and a bottom member which is generally Y-shaped, which contains a Y-shaped passageway theretherough, which is affixed on the ends of its two upper arm members to the bottom surface of cylindrical body so as to have each of its upper arms communicate with one of the two remaining, oppositely located passageways in the cylindrical body, the central axis of the bottom Y-shaped member generally lying on the central axis of the cylindrical body, the bottom leg of the bottom Y-shaped member attached to the bottom portion of the drill pipe, the Y-shaped passageway of the bottom member communicating with the bottom portion of the drill pipe, the cylindrical body tightly and rotably fitting within the well casing.

12. In the combination as claimed in claim 11 wherein the cylindrical body comprises two segments which are rotatable in relation to each other, thereby allowing the planes at an angle to each other or in the same plane, whereby the flow of the circulating fluid can be reversed, stopped or made in line.

* * * * *